US007165902B2

(12) United States Patent
Ejiri et al.

(10) Patent No.: US 7,165,902 B2
(45) Date of Patent: Jan. 23, 2007

(54) PRINTER AND PRINTER CONTROL METHOD

(75) Inventors: Keigo Ejiri, Nagano-ken (JP); Toshiaki Koike, Shiojin (JP); Noboru Otsuki, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 11/075,056

(22) Filed: Mar. 7, 2005

(65) Prior Publication Data

US 2005/0214055 A1 Sep. 29, 2005

(30) Foreign Application Priority Data

Mar. 5, 2004 (JP) ..... 2004-062300
Mar. 15, 2004 (JP) ..... 2004-072683

(51) Int. Cl.
*B41J 11/58* (2006.01)
*B65H 5/00* (2006.01)

(52) U.S. Cl. ..... 400/625; 271/225; 271/902

(58) Field of Classification Search ..... 400/625, 400/624, 611, 579; 271/225, 902, 184, 111, 271/121, 12–15; 347/16, 101, 104; 358/1.1, 358/1.6; 399/406
See application file for complete search history.

(56) References Cited

U.S. PATENT DOCUMENTS 3,936,041 A * 2/1976 Shiina et al. ..... 271/4.03
4,325,086 A * 4/1982 Sato et al. ..... 358/296
4,475,128 A * 10/1984 Koumura ..... 358/296
4,565,461 A * 1/1986 Usui et al. ..... 400/611
5,118,089 A * 6/1992 Yamada et al. ..... 271/3.16
5,415,391 A * 5/1995 Wong et al. ..... 271/225
5,672,019 A 9/1997 Hiramatsu et al. ..... 400/624
5,978,552 A * 11/1999 Kobori ..... 358/1.6
6,012,809 A * 1/2000 Ikeda et al. ..... 347/101
6,293,716 B1 * 9/2001 Driggers et al. ..... 400/578
6,499,822 B1 * 12/2002 Abe et al. ..... 347/19
6,845,227 B1 * 1/2005 Nishino et al. ..... 399/406
6,869,241 B1 * 3/2005 Ouchi et al. ..... 400/578
6,877,738 B1 * 4/2005 Sonoda et al. ..... 271/121
2002/0175462 A1 11/2002 Sonoda et al. ..... 271/121

(Continued)

FOREIGN PATENT DOCUMENTS

EP 1 096 421 A2 5/2001

(Continued)

*Primary Examiner*—Judy Nguyen
*Assistant Examiner*—Wasseem H. Hamdan
(74) *Attorney, Agent, or Firm*—Anderson Kill & Olick, PC

(57) ABSTRACT

A printer and control method to control the operation of a printer to assure consistent print quality regardless of the paper length. A paper transportation control unit 101 and ASF control unit 103 drive a paper feed roller 78 and main paper transportation roller 23 for feeding a sheet S of print paper from the ASF 60 upon a paper transportation path and for advancing the sheet S of print paper on the paper transportation path in a first direction until the sheet S of print paper is discharged from the ASF 60, and then reversing the direction of travel of the sheet of paper S on the paper transportation path to convey the sheet S upon a reverse paper transportation path 80 disposed below the ASF 60 while positioning the sheet S to the print head 25*a* for printing by the print head 25*a*.

7 Claims, 14 Drawing Sheets

U.S. PATENT DOCUMENTS

| | | | | |
|---|---|---|---|---|
| 2004/0004322 | A1* | 1/2004 | Jang | 271/121 |
| 2004/0156666 | A1 | 8/2004 | Ouchi et al. | 400/708 |
| 2004/0252176 | A1* | 12/2004 | Sugiura | 347/104 |
| 2005/0253886 | A1* | 11/2005 | Nakajima et al. | 347/16 |

FOREIGN PATENT DOCUMENTS

| | | |
|---|---|---|
| JP | 5-261991 | 10/1993 |
| JP | 6-115731 | 4/1994 |
| JP | 06-336064 | 6/1994 |
| JP | 08-259101 | 10/1996 |
| JP | 08-272161 | 10/1996 |
| JP | 09-030074 | 2/1997 |
| JP | 11-034414 | 2/1999 |
| JP | 2000-296645 | 10/2000 |
| JP | 2000-318240 | 11/2000 |
| JP | 2001-125321 | 5/2001 |
| JP | 2001-287427 | 10/2001 |
| JP | 2002-338065 | 11/2002 |
| JP | 2002-348019 | 12/2002 |
| JP | 2003-26349 | 1/2003 |
| JP | 2003-260835 | 9/2003 |
| JP | 2004-59192 | 2/2004 |

* cited by examiner

PRINTER AND PRINTER CONTROL METHOD

BACKGROUND OF THE INVENTION

1. Field of the Invention

The present invention relates to a printer that prints on single sheets, and to a printer control method.

2. Description of Related Art

Inkjet printers use a piezoelectric, thermal, or electrostatic actuator to discharge ink droplets to paper positioned on a platen, and thus print the discharged ink droplets on the paper. A roll paper holder or automatic sheet feeder (ASF) is usually attached to the inkjet printer, roll paper is supplied from the roll paper holder or single sheets are supplied from the ASF and conveyed in a particular direction, and these paper transportation and ink droplet discharge operations are controlled to print on the paper.

This operation is described in further detail next using an inkjet printer with an ASF by way of example. A pickup roller inside the ASF first picks and delivers a sheet from the ASF tray to the printer. Feed rollers then carry the paper to the printing area opposite the print head, and then advance the paper a specific distance at a specific interval in the paper transportation direction while ink droplets are discharged from the print head to the paper, thus recording letters, images, or other content on the paper. An inkjet printer with an ASF can thus continuously feed a plurality of sheets one at a time through the printing area inside the printer. See, for example, Japanese Unexamined Patent Application 2001-287427.

In order to feed paper from the ASF and position the paper relative to the print head, this type of inkjet printer typically uses two paper detectors to detect the leading edge and trailing edge positions of each sheet, and positions the paper to the print head based on the detected positions of the leading and trailing edges of the paper.

When the length of the paper transportation path in the printer is shorter than the length in the transportation direction of the paper used for printing, the paper will be positioned to the print head while the trailing edge of the paper remains inside the ASF, and printing may thus start while part of the paper remains inside the ASF. If printing starts while the trailing portion of the paper remains inside the ASF, the paper may be held in a large curl while printing continues depending on the position of the ASF relative to the printer (more specifically depending on the shape of the transportation path from where the paper is supplied from the ASF to the paper exit from the printer). Thus curling the paper increases the paper tension, and can thus adversely affect the feed pitch of the paper. Situations in which the paper cannot be advanced at the specified pitch and can thus only be fed at a smaller than expected pitch can even occur.

If the transportation length of the paper is shorter than the length of the paper transportation path in the printer, however, the paper is printed after the trailing edge of the paper is completely discharged from the ASF. In this case the printing paper is deposited flat on the paper transportation path from the leading edge to the trailing edge of the paper. The paper can therefore be fed and printed at the expected feed pitch because there is no additional tension on the paper.

When the leading end portion of the paper is printed while the trailing end is still held in the ASF but the trailing end portion of the paper is printed after the paper is completely discharged (freed) from the ASF, the feed pitch may vary between the leading and trailing ends of the same sheet of paper.

A further problem is that if the shape of the paper being printed differs according to the length of the paper in the transportation direction (the "transportation length" below), the feed pitch of the printer will also differ according to the shape of the paper being printed. Furthermore, a shift in the feed pitch also causes the dot pitch to vary in the paper transportation direction, thus causing the print quality to vary.

SUMMARY OF THE INVENTION

The present invention is directed to solving the foregoing problems, using a printer and a printer control method that suppress variation in the paper feed pitch during printing and thus provide stable print quality.

To achieve the foregoing, a printer according to the present invention has a paper storage housing for storing paper; a paper transportation path formed between a paper entrance and a paper exit for conveying the paper; a paper feed roller for conveying paper from the paper storage housing into the paper transportation path; a transportation roller disposed along the paper transportation path for conveying paper in a first direction along the paper transportation path or in a second direction that is opposite the first direction; a print head disposed along the paper transportation path; and a paper transportation control unit for conveying the paper supplied from the paper storage housing by the paper feed roller in the first direction by means of the transportation roller until the trailing edge of the paper is discharged from the paper storage housing, and then conveying and positioning the paper in the second direction to the print head.

This printer preferably also has a first paper detector disposed along the paper transportation path for detecting if paper is present. In this case, the paper transportation control unit conveys the paper in the second direction based on change in the first paper detector from the paper-present to the paper-not-present state while the paper is conveyed in the first direction.

Further preferably, the printer also has a second paper detector disposed along the paper transportation path on the downstream side in the first direction from the print head and first paper detector for detecting if paper is present. The paper transportation control unit in this aspect of the invention positions the paper to the print head based on change in the second paper detector from the paper-present to the paper-not-present state during transportation in the second direction.

Yet further preferably, the first paper detector, transportation roller, print head, and second paper detector are arranged in this sequence along the paper transportation path from the paper storage housing side. This shortens the transportation distance required to position the paper for printing, and is thus more efficient.

Further alternatively, the printer also has a counter for measuring a length of the paper conveyed along the paper transportation path based on detector output from the first paper detector. In this case the paper transportation control unit conveys the paper in the second direction and positions the paper to the print head based on the paper length detected by the counter. Control is thus possible using only one paper detector. The transportation length of the paper can be acquired by a paper length information acquisition unit from print data supplied from the host device or data input by the user, for example.

The present invention can also be rendered as a printer control method, and this printer control method provides the same operation and effects described above.

Other advantages and attainments together with a fuller understanding of the invention will become apparent and appreciated by referring to the following description and claims taken in conjunction with the accompanying drawings.

DESCRIPTION OF THE PREFERRED EMBODIMENTS

Preferred embodiments of the present invention are described below with reference to the accompanying figures. An inkjet printer according to this embodiment of the invention has a main printer unit 1 and an ASF (automatic sheet feeder) 60 that is removably attached to the main printer unit 1.

Arrangement of the Main Printer Unit 1

Figure 1:
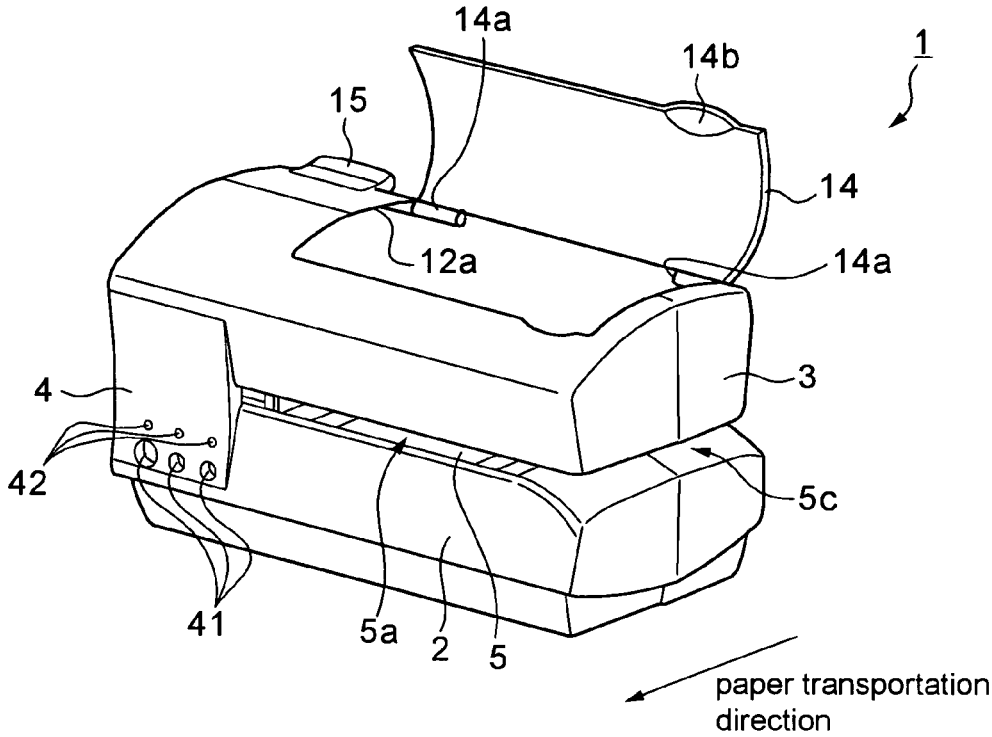
FIG. 1 is an oblique view from the front of the main printer unit of an inkjet printer according to the present invention.
Figure 2:
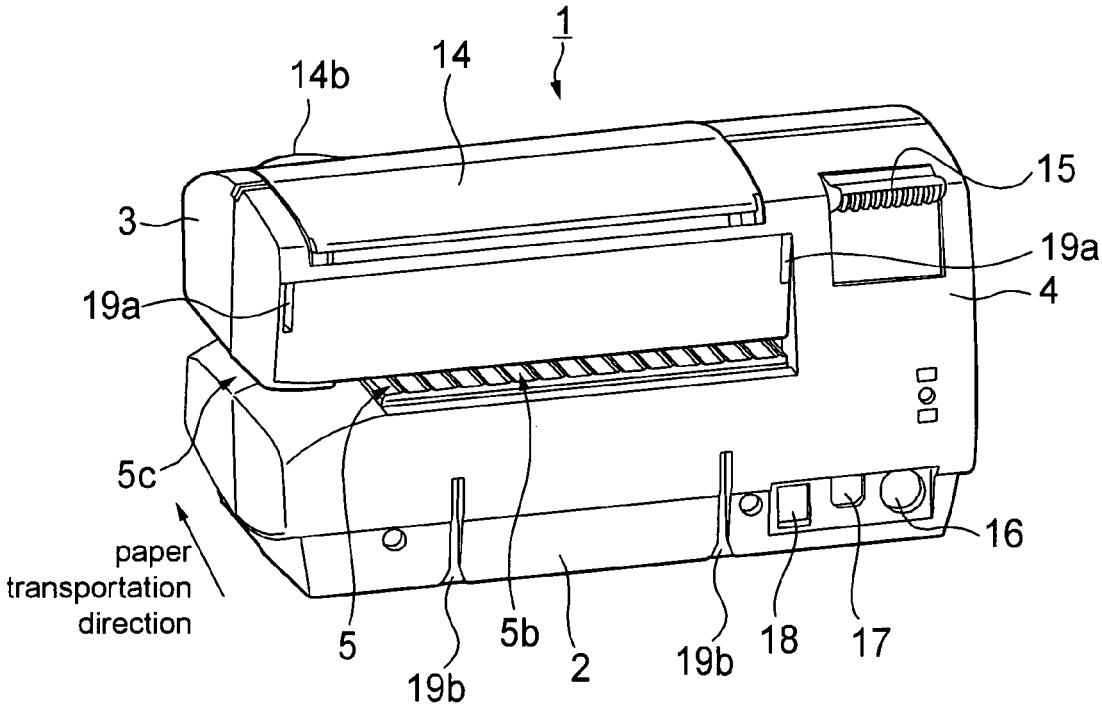
FIG. 2 is an oblique view from the back of the main printer unit of an inkjet printer according to the present invention.

The main printer unit 1 of an inkjet printer according to the present invention includes an image recording unit 3 as shown in FIGS. 1 and 2 supported in a cantilevered manner by a cantilever base portion 4 at one end of the printer's base unit 2 and a paper transportation path 5 for conveying paper from the back to the front of the printer. The paper transportation path 5 is formed between the base unit 2 and image recording unit 3.

The front-side opening 5*a*, back-side opening 5*b*, and side opening 5*c* of the paper transportation path 5 are contiguous with no interruptions therebetween. Paper inserted to the paper transportation path 5 from any of these openings is conveyed from the back-side opening 5*b* toward the front-side opening 5*a*, which is referred to herein as the "forward direction." Transportation from the front-side opening 5*a* toward the back-side opening 5*b* is in the "reverse direction."

A cover 14 is attached openably and closeably to the top of the image recording unit 3 by means of a hinge 14*a*. A finger tab 14*b* for opening and closing the cover 14 is formed at the right front part of the cover 14 so that the user can easily open and close the cover 14. When the cover 14 is open, the ink supply tank inside the printer can be replaced and other maintenance operations can be performed.

Figure 3:
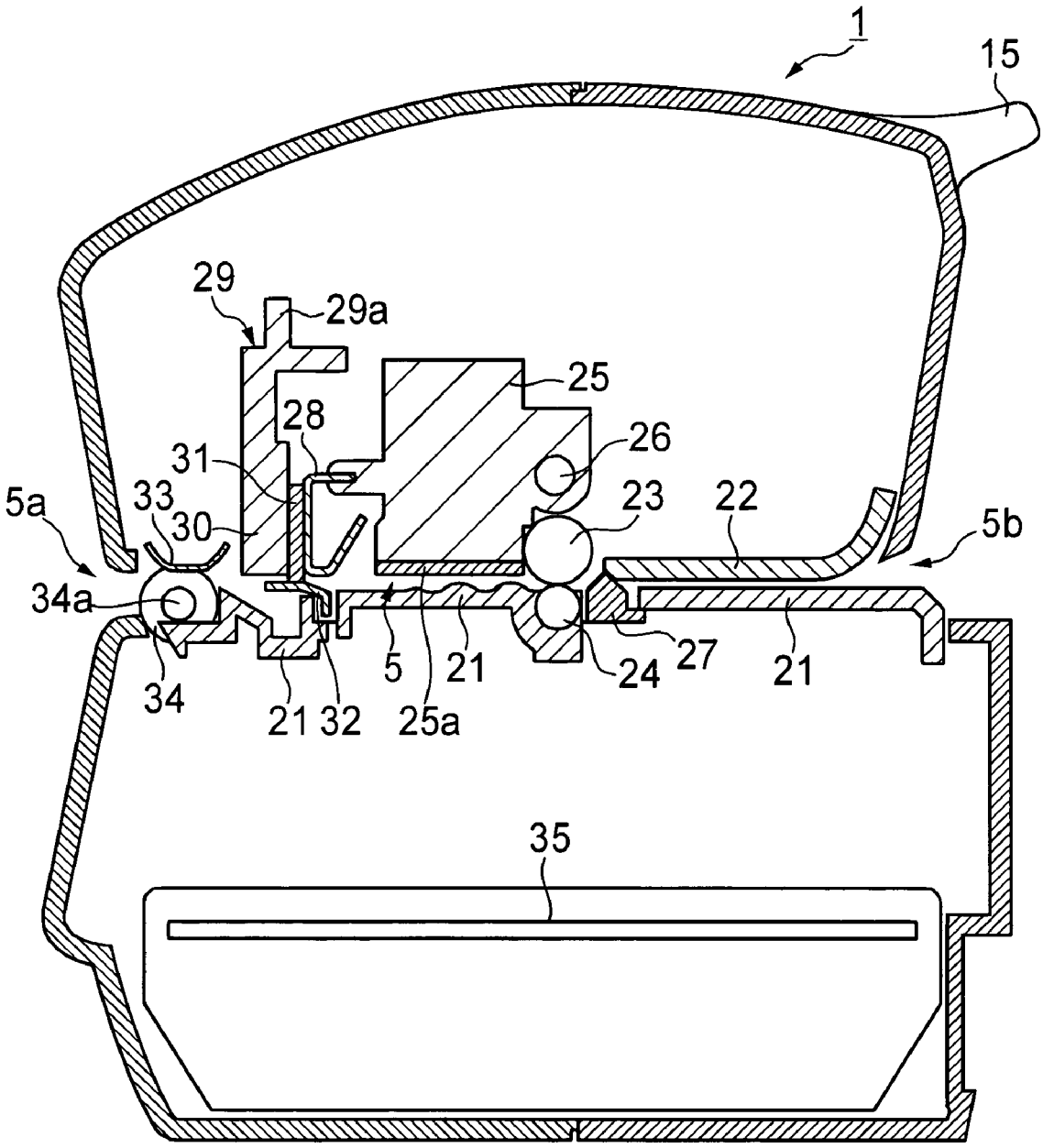
FIG. 3 is a section view showing main parts of the internal construction of the main printer unit when the platen is closed.
Figure 4:
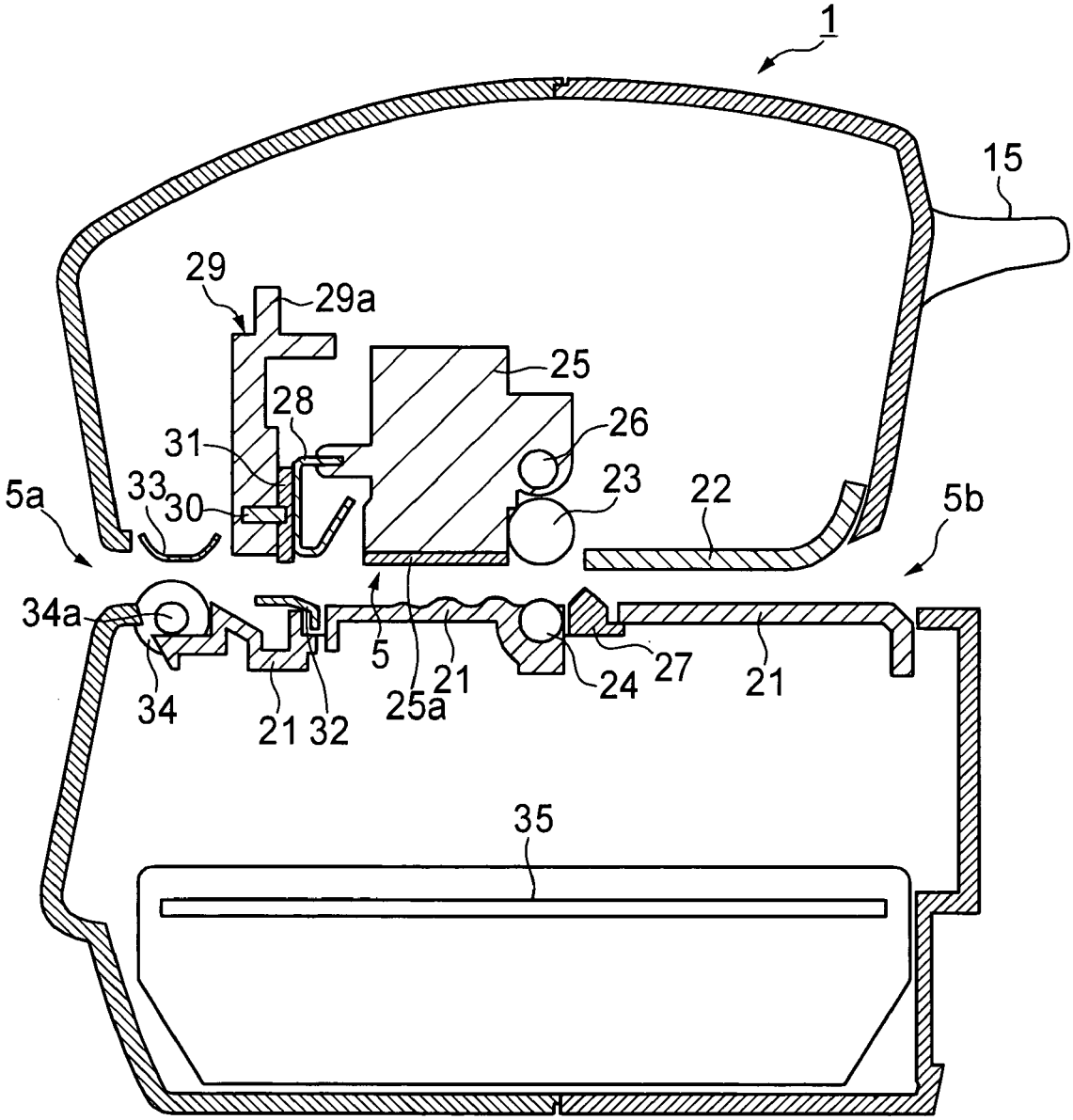
FIG. 4 is a section view showing main parts of the internal construction of the main printer unit when the platen is open.

A release lever 15 is disposed on the back of the cantilever base portion 4. The release lever 15 is disposed so that the release lever 15 can be pushed down and the platen 21 and the other parts associated with the platen 21 move up and down in conjunction with operating the release lever 15. The platen 21 is described further below and forms part of the paper transportation path 5 (see FIG. 3 and FIG. 4). Paper can be manually inserted to the paper transportation path 5 by depressing the release lever 15 and lowering the platen 21, thus opening the paper transportation path 5 as shown in FIG. 4. Returning the release lever 15 to the raised (closed) position raises the platen 21 and associated parts, thus closing the paper transportation path 5 as shown in FIG. 3 so that paper cannot be manually inserted.

Below the cantilever base portion 4 are provided a power cable connector 16 to which a power cable for supplying power from an external power source to the main printer unit 1 is connected, a data communication terminal 17 for connecting a USB or other cable for data communication with a host computer, and an ASF power cable connector 18 for connecting an ASF power cable to supply power from the main printer unit 1 to the ASF 60.

The ASF power cable connector 18 has a cable connection confirmation pin (not shown in the figure) for confirming if the ASF power supply cable is connected. This cable connection confirmation pin is used as an ASF connector sensor, and shorts when the ASF power supply cable is connected to the ASF power cable connector 18. The main printer unit 1 can thus confirm whether the ASF 60 is connected or not by detecting the status of this cable connection confirmation pin. It will be obvious to one with ordinary skill in the related art that whether the ASF 60 is connected could also be determined by using a photodetector to optically detect if the ASF 60 is connected, or by setting a switch disposed to the main printer unit 1 to indicate whether the ASF 60 is connected.

Two slits 19*a* for attaching an ASF 60, and two channels 19*b* for attaching a roll paper holder (not shown in the figure), are also formed in the back of the image recording unit 3 as shown in FIG. 2 so that an ASF 60 or roll paper holder can be attached according to the type of paper used.

Operating buttons 41 for operating the power switch and other operating switches, and status indicators 42 such as LEDs for indicating the operating status of the inkjet printer, are also provided on the front of the cantilever base portion 4.

Internal Structure of the Main Printer Unit

FIG. 3 and FIG. 4 are section view showing main parts of the internal structure of the main printer unit 1 when the platen 21 is closed and when the platen 21 is open, respectively. The platen 21 is located on the bottom of the paper transportation path 5 from the back-side opening 5*b* to the front-side opening 5*a*. The platen 21 is a flat member forming the top of the base unit 2. A paper guide 22, main paper transportation roller 23, carriage 25, automatic paper cutter 29, and TOF lever 33 are disposed on the top side of the paper transportation path 5 sequentially from the upstream side (the back-side opening 5*b* side). A control circuit board 35 is located below the platen 21.

The paper guide 22 is disposed opposite the platen 21 on the upstream side of the paper transportation path 5. The paper guide 22 on the top side of the paper transportation path 5 is convexly curved so that paper supplied from the back-side opening 5*b* can be smoothly inserted to the paper transportation path 5. Paper inserted from the back-side opening 5*b* is conveyed between the platen 21 and paper guide 22 and transported to the main paper transportation roller 23.

The main paper transportation roller 23 is driven by the paper feed motor 130 (see FIG. 7), and can move forward and reverse. Paper is nipped between the main paper transportation roller 23 and the pressure roller 24 disposed opposite the main paper transportation roller 23, and is conveyed either forward or reverse according to the direction of main paper transportation roller 23 rotation.

A BOF lever 27 is disposed on the platen 21 side upstream of the main paper transportation roller 23. The BOF lever 27 is pressed down when paper passes over the BOF lever 27. This displacement of the BOF lever 27 is detected by a linking mechanism formed in unison with the BOF lever 27 and a BOF sensor 27*a* (see FIG. 7) such as a photodetector. Whether the leading edge or trailing edge of the paper is located at the position detected by the BOF lever can be determined from the detector output from the BOF sensor 27*a* and the direction of paper transportation.

A carriage 25 is disposed opposite the top of the platen 21 downstream from the main paper transportation roller 23. The carriage 25 is supported by a guide shaft 26 and guide plate 28 disposed perpendicularly to the paper transportation direction, that is, across the width of the paper. The carriage 25 can slide widthwise to the paper along the guide shaft 26 and guide plate 28.

A print head 25*a* having a plurality of openings (nozzles) for discharging ink droplets is disposed to the carriage 25 facing the platen 21 for discharging ink and printing on paper placed on the platen 21.

The automatic paper cutter 29 is located downstream from the carriage 25. The automatic paper cutter 29 has a cutter guide member 29*a* slidably fixed on the image recording unit 3 side, and a disk-shaped rotating cutter blade 31. The rotating cutter blade 31 is disposed between the cutter guide member 29*a* and guide plate 28, and is supported rotatably to the cutter guide member 29*a* by an intervening rotary shaft 30. The rotating cutter blade 31 is disposed opposite a fixed blade 32 disposed to the platen 21. The automatic paper cutter 29 cuts roll paper inserted above the fixed blade 32 by moving the rotating cutter blade 31 with the cutter guide member 29*a* across the width of the paper while pressing the rotating cutter blade 31 against the fixed blade 32.

Paper transportation sub-roller 34 is disposed downstream from the automatic paper cutter 29 near the front-side opening 5*a*. The rotary shaft 34*a* of the paper transportation sub-roller 34 is rotatably axially supported on the platen 21. The paper transportation sub-roller 34 is disposed opposite the paper transportation sub-roller guide (not shown) for conveying paper nipped between the paper transportation sub-roller guide and sub-roller 34 in the forward or reverse direction. The paper is conveyed forward by the paper transportation sub-roller 34 and discharged from the front-side opening 5*a*.

A TOF lever 33 is disposed above the paper transportation path 5 near the paper transportation sub-roller 34. This TOF lever 33 is pushed up when the paper contacts the bottom of the TOF lever 33. Displacement of the TOF lever 33 is sensed by a TOF sensor 33*a* (see FIG. 7) composed of an optical sensor and linkage mechanism formed in unison with the TOF lever 33. Whether the leading edge or the trailing edge of the paper is located at the detection position of the TOF lever 33 can be determined based on the detector output from the TOF sensor 33*a* and the direction of paper travel.

The control circuit board 35 disposed below the platen 21 has a CPU for centrally controlling the operation of the various control units of the main printer unit 1, and memory for temporarily storing print commands and print data received through the data communication terminal 17 from an external source. Detection signals from the BOF sensor 27*a*, TOF sensor 33*a*, and ASF attachment sensor are sent to the control circuit board 35 and used to determine the position of the paper and whether an ASF 60 is connected. The arrangement of the control circuit board 35 is described in further detail below.

Automatic Sheet Feeder (ASF)

Figure 5:
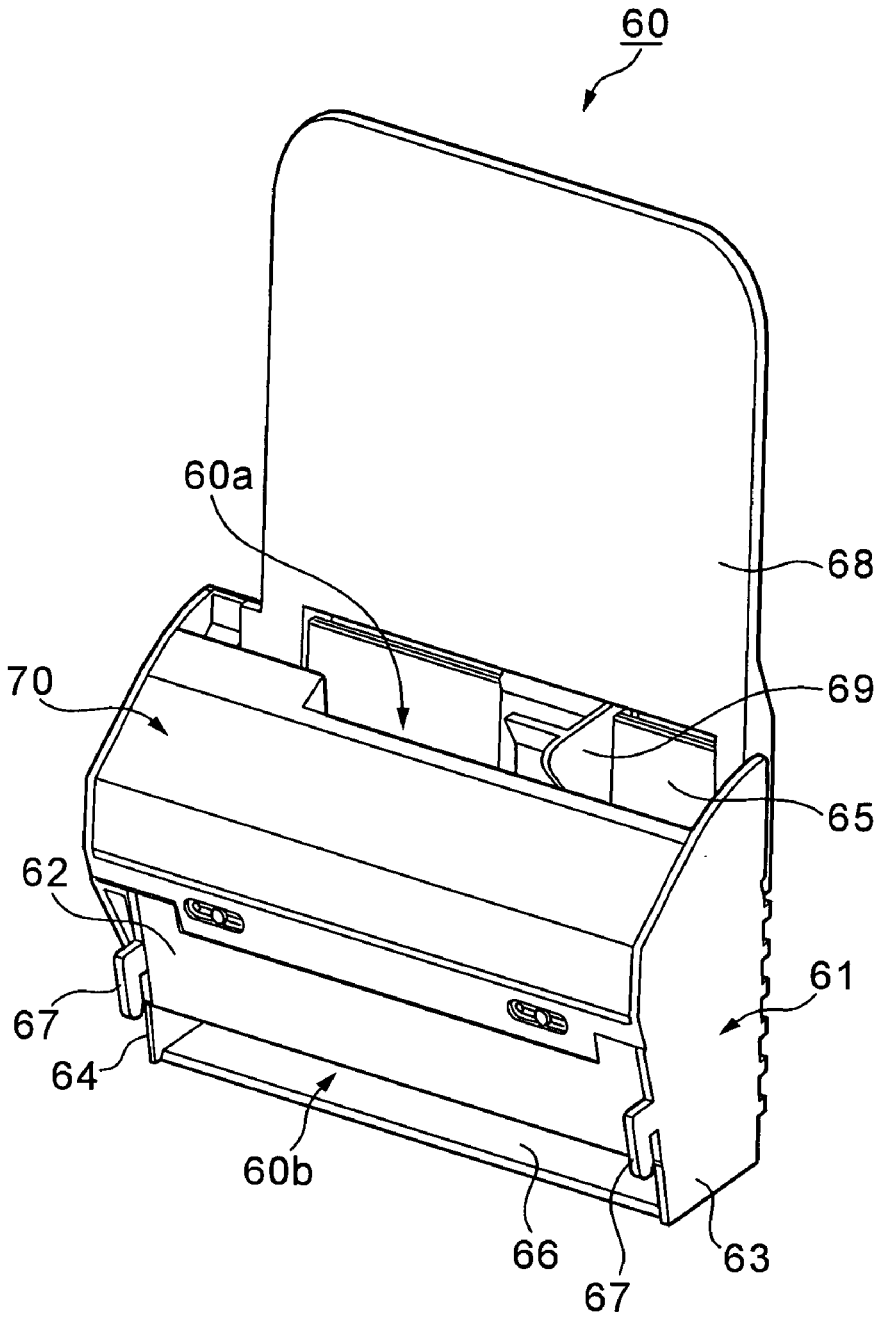
FIG. 5 is an oblique view showing an ASF attached to the main printer unit.
Figure 6:
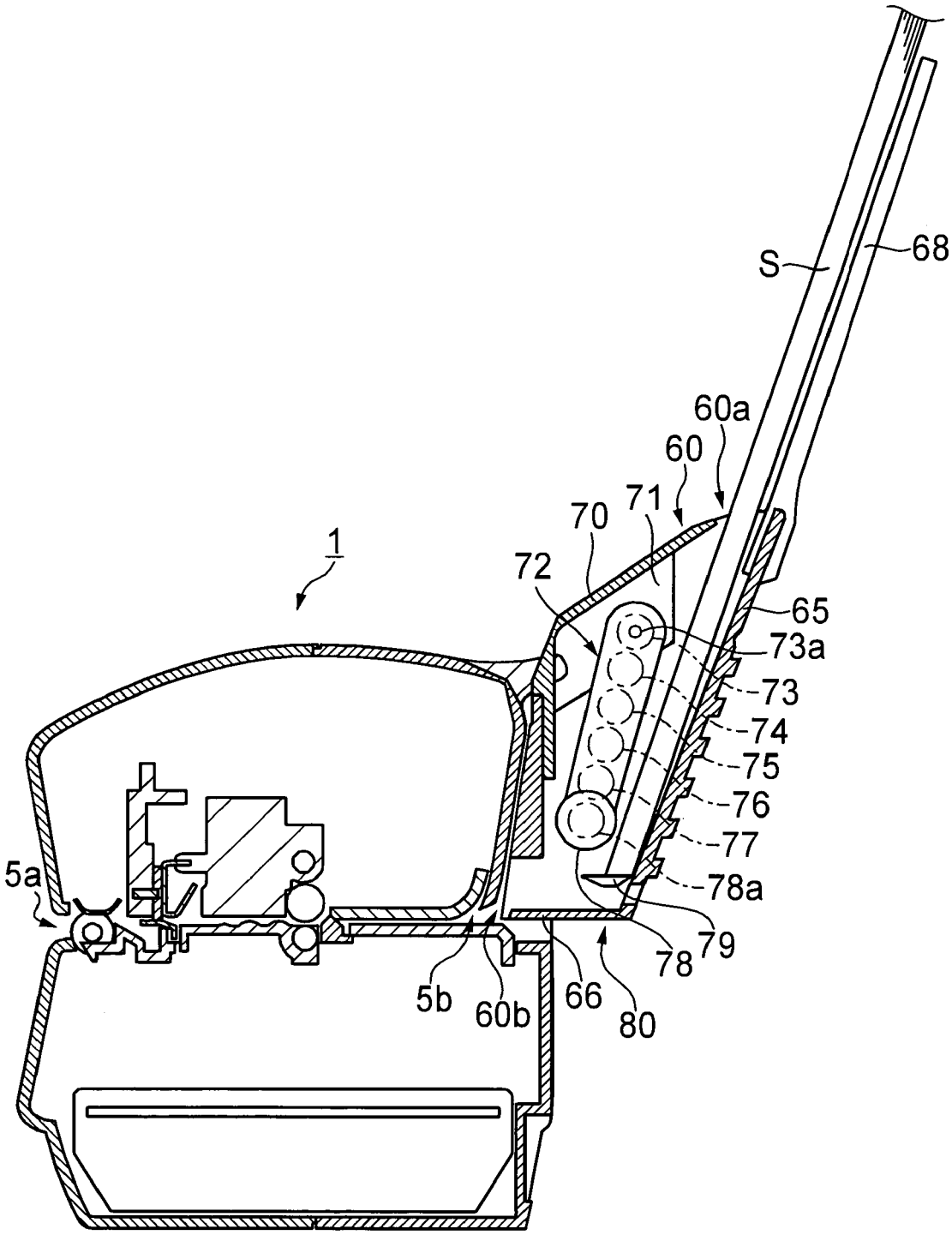
FIG. 6 is a section view showing the main printer unit with the ASF attached thereto.

FIG. 5 is an oblique view of an ASF 60 that mounts to the main printer unit 1. FIG. 6 is a section view showing the ASF 60 when attached to the main printer unit 1. The ASF 60 is a paper supply device comprising a paper storage housing represented by a bottom case 61 that holds multiple sheets of paper and a paper supply roller unit 72 which feeds the paper one sheet at a time into the main printer unit 1. The main parts of the ASF 60 independent of the paper supply roller unit 72 are the bottom case 61 and top cover 70.

The bottom case 61 is a molded plastic box having a front panel 62 and an opposite back panel 65 formed in unison with side panels 63 and 64, and a bottom panel 66 formed in unison with the back panel 65 and side panels 63 and 64. A top opening 60*a* is thus formed between the front panel 62, back panel 65, and side panels 63 and 64 at the top part of the bottom case 61. The top cover 70 is inserted from this top opening 60*a* and fit to the bottom case 61 so as to cover part of the top opening 60*a*. The part of this top opening 60*a* that is not covered by the top cover 70 is the cut-sheet insertion opening through which multiple single sheets S can be loaded.

A flat paper guide 68 for supporting the back of the single sheets S is attached to the top of the back panel 65. An adjustable paper width guide 69 for guiding one edge of the single sheets S is also disposed at the top of the back panel 65. This paper width guide 69 can slide along the top of the back panel 65 so that the guide 69 can be appropriately adjusted to the width of the paper. By sliding the paper width guide 69 to adjust the width between paper width guide 69 and side panel 63 substantially to the width of the single sheets S loaded in the ASF 60, single sheets S can be inserted and conveyed guided by the side panel 63 and paper width guide 69 so that the paper does not become skewed.

A bottom opening 60*b* is formed at the bottom of the bottom case 61 between the front panel 62, bottom panel 66, and side panels 63 and 64. This bottom opening 60*b* is the paper exit from which a single sheet S inserted from the top opening 60*a* (cut-sheet insertion opening) is discharged from the ASF 60.

As shown in FIG. 5, L-shaped mounting tabs 67 are formed on the front edge part of the side panels 63 and 64. These mounting tabs 67 are disposed at positions corresponding to the slits 19*a* formed in the back of the main printer unit 1 as shown in FIG. 2. The ASF 60 is attached to the main printer unit 1 by engaging these mounting tabs 67 with the slits 19*a*. Note that when the ASF 60 is attached to the main printer unit 1 in this embodiment of the invention the bottom of the bottom panel 66 is at an elevation above the top of the platen 21.

As shown in FIG. 6 multiple single sheets S are inserted to the ASF 60 in a stack guided by the inside surface of the back panel 65. The bottom ends of the single sheets S contact and are supported by a rotatably disposed movable pad 79. When paper is supplied from the ASF 60, the leading edge of the sheet S pushes against the movable pad 79 and thus causes the movable pad 79 to tilt, thus facilitating separation of the paper and enabling the single sheets S to be more easily fed one sheet at a time.

A rib 71 formed in unison with the top cover 70 projects from the inside surface of the top cover 70, that is, from the side of the top cover 70 facing the back panel 65. A paper supply roller unit 72 for feeding the single sheets S into the main printer unit 1 is attached to this rib 71.

The paper supply roller unit 72 has a first gear 73 with a drive shaft 73*a* that is driven by the ASF motor 140 (see FIG. 7), which is connected to the ASF power cable connector 18, a second gear 74 engaging the first gear 73, a third gear 75 engaging the second gear 74, a fourth gear 76 engaging the third gear 75, a fifth gear 77 engaging the fourth gear 76, a sixth gear 78*a* engaging the fifth gear 77, and a paper feed roller 78.

When the drive shaft 73*a* of the first gear 73 is driven forward, the paper supply roller unit 72 rotates in the direction approaching the single sheets S so that the paper feed roller 78 contacts the top sheet S and is held pressed against the paper. When the drive shaft 73*a* of the first gear 73 is driven in reverse, the paper supply roller unit 72 rotates in the direction separating from the sheets S, and the paper feed roller 78 is held separated from the paper. If the drive shaft 73*a* is driven while the paper feed roller 78 is pressed against a sheet S, the torque of the drive shaft 73*a* is transferred from the first gear 73 through the second to fifth gears 74 to 77 to the sixth gear 78*a*, and the paper feed roller 78 disposed coaxially to the sixth gear 78*a* thus turns.

To feed a sheet S into the main printer unit 1, the drive shaft 73*a* of the paper supply roller unit 72 is driven forward, thus causing the paper supply roller unit 72 to rotate to the sheet S and press the paper feed roller 78 against the surface of the top sheet S. When the drive shaft 73*a* is driven further in the forward direction from this position, the paper feed roller 78 rotates in the paper feeding direction (clockwise as seen in FIG. 6) and delivers the top sheets S on the stack of multiple single sheets S from the bottom opening 60*b* at a constant speed through the back-side opening 5*b* of the main printer unit 1 and into the paper transportation path 5. The main printer unit 1 prints on the paper as the sheet S is advanced, and discharges the sheet from the front-side opening 5*a*.

The bottom panel 66 is positioned near an extension of the paper transportation path 5 so that the space below the bottom panel 66 communicates in a straight line with the paper transportation path 5. More specifically, because the paper transportation path 5 is substantially horizontal, the bottom panel 66 is positioned vertically above an extension of the paper transportation path 5, that is, above the paper transportation path 5 in the direction of the acceleration of gravity. This enables paper to be manually inserted from the back-side opening 5*b* to the paper transportation path 5 because the back-side opening 5*b* is not blocked by the ASF 60 when the ASF 60 is attached to the main printer unit 1. In addition, paper that is conveyed in the reverse direction from the paper transportation path 5 toward the ASF 60 is guided by gravity along the extension of the paper transportation path 5 or therebelow, and thus does not enter the ASF 60 from the bottom opening 60*b*.

Note that the space below the bottom panel 66 communicating with the paper transportation path 5 is referred to herein below as the reverse paper transportation path 80.

The main printer unit 1 in this embodiment of the invention is arranged so that the sheet S is advanced in the forward direction until the sheet S is completely discharged from the bottom opening 60*b* of the ASF 60 and the trailing edge of the sheet S is detected inside the main printer unit 1, and the sheet S is then reversed toward the reverse paper transportation path 80 and positioned to the print head 25*a*. The specific paper transportation sequence is described in further detail below.

Inkjet Printer Control Circuit

Figure 7:
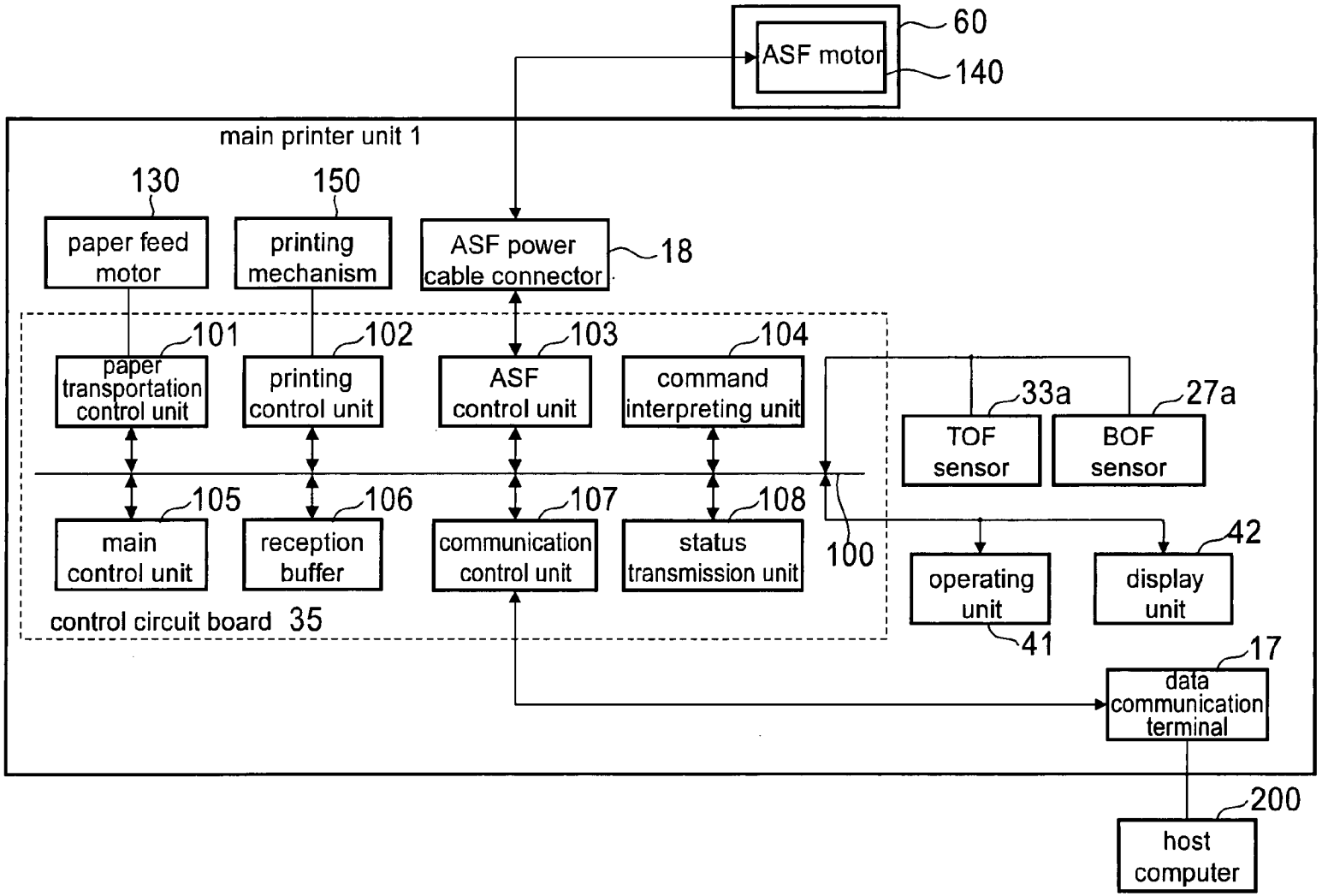
FIG. 7 is a control block diagram of the inkjet printer.

FIG. 7 is a control block diagram of an inkjet printer schematically showing the main components related to the present invention. A control circuit board 35 is disposed inside the main printer unit 1 for controlling the ASF 60 and control mechanisms of the main printer unit 1 according to print data and commands sent from a host computer 200. A paper transportation control unit 101, printing control unit 102, ASF control unit 103, command interpreting unit 104, main control unit 105, reception buffer 106, communication control unit 107, and status transmission unit 108 are mounted on the control circuit board 35 and connected to communicate with each other via a bus 100. Operation is controlled according to firmware read from ROM not shown.

The paper transportation control unit 101 generates control signals for controlling driving the paper feed motor 130. The paper feed motor 130 is thus driven according to these control signals to rotationally drive the main paper transportation roller 23 and paper transportation sub-roller 34, thus conveying a sheet S through the paper transportation path 5.

The printing control unit 102 controls driving the printing mechanism 150 including the carriage 25 and print head 25*a*. More specifically, the printing control unit 102 controls positioning the carriage 25, ink discharge from the print head 25*a*, and print head 25*a* maintenance operations.

The ASF control unit 103 supplies a sheet S into the paper transportation path 5 by driving the ASF motor 140 disposed inside the ASF 60 to rotate the paper feed roller 78.

The command interpreting unit 104 interprets the print data and control commands sent from the host computer 200. The paper transportation control unit 101, printing control unit 102, ASF control unit 103, and other control units operate according to the results output from the command interpreting unit 104.

The main control unit 105 provides central control of and arbitrates signal communication between the control units and memory disposed to the control circuit board 35.

The reception buffer 106 is temporary data storage for print data and commands sent from the host computer 200.

The communication control unit 107 communicates with the host computer 200 through the data communication terminal 17. Commands and print data sent from the host computer 200 are temporarily stored in the reception buffer 106 by the communication control unit 107 and used by the various control units.

The status transmission unit 108 generates status signals indicating the status of the main printer unit 1, and sends the status signals through the communication control unit 107 and data communication terminal 17 to the host computer 200. The host computer 200 can determine the status of the main printer unit 1 from the received status signals. The printer status can also be indicated using the status indicators 42, and the status information can be printed by the print head 25*a*, based on the status signals generated by the status transmission unit 108.

The TOF sensor 33*a* and BOF sensor 27*a* detect the presence of paper at the respective detection positions, and output the resulting detection signals to the control circuit board 35. The detection signals from the TOF sensor 33*a* and BOF sensor 27*a* are sent over the bus 100 to the main control unit 105. The main control unit 105 then controls the paper transportation control unit 101, printing control unit 102, and ASF control unit 103 based on these detection signals.

Controlling Inkjet Printer Operation

Figure 8:
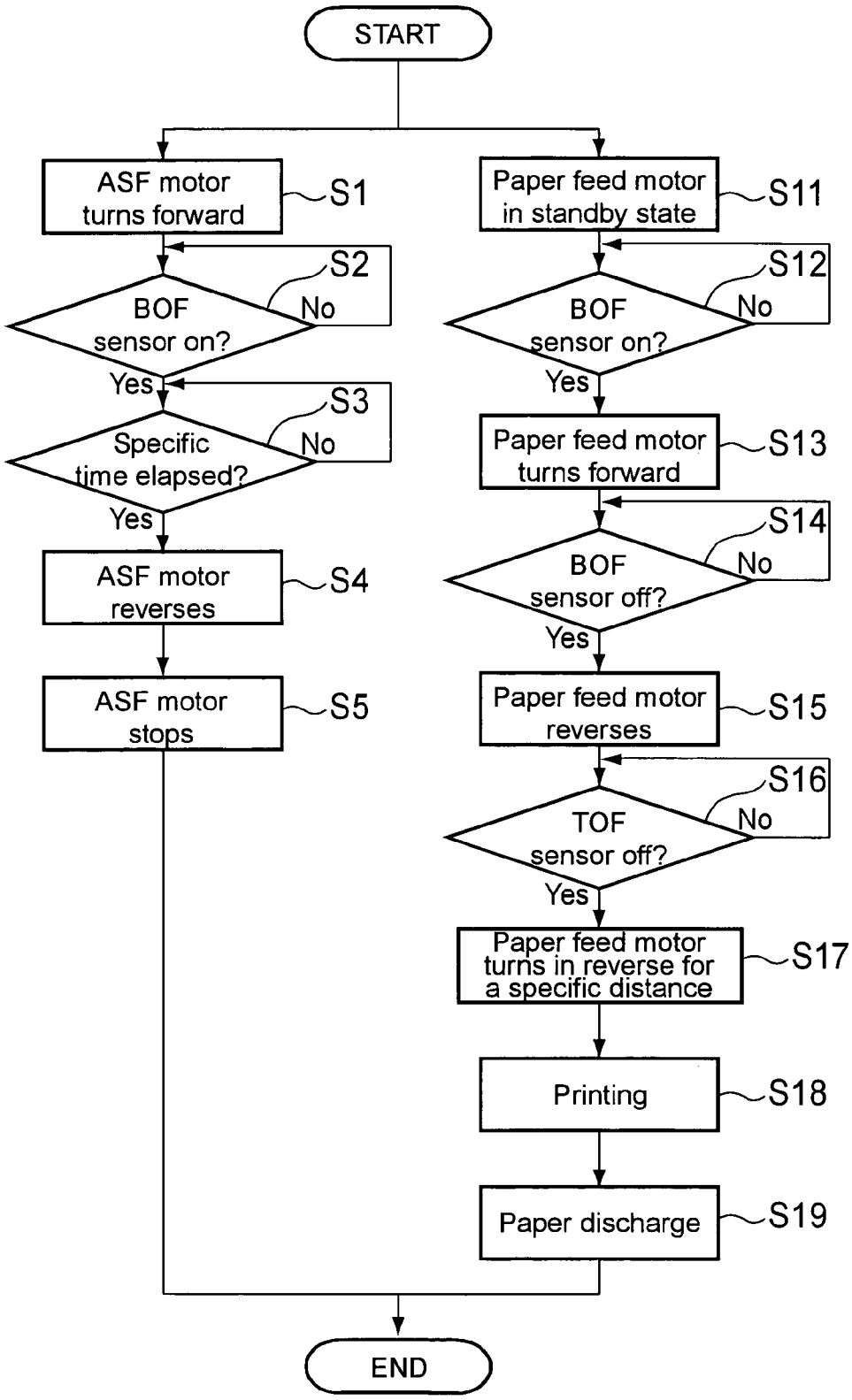
FIG. 8 is a flow chart describing the operating sequence of the inkjet printer when the ASF is attached to the main printer unit.

FIG. 8 is a flow chart showing the operating sequence of an inkjet printer when the ASF 60 is attached to the main printer unit 1. FIG. 9A to FIG. 9G schematically show the movement (transportation) of the paper. Transportation control of a single sheet S is described below.

Figure 9A:
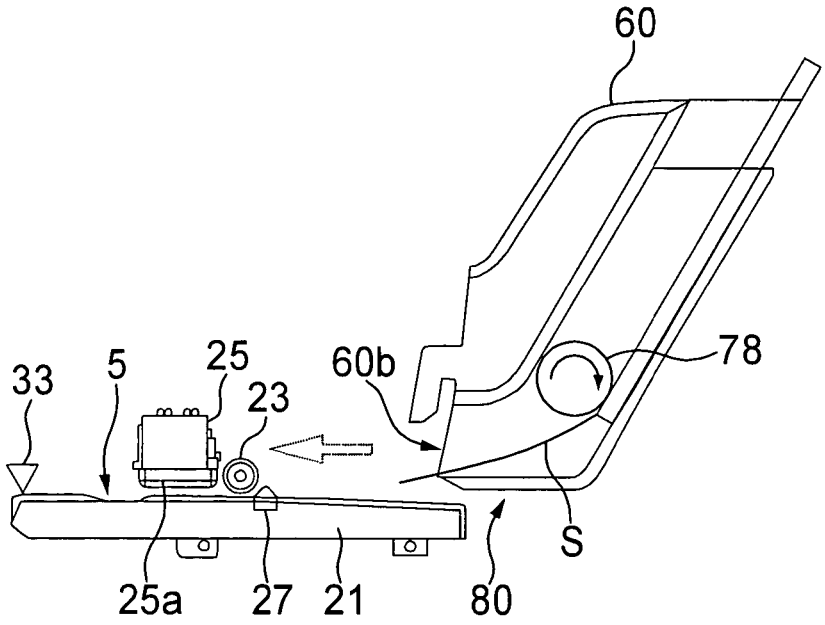
FIG. 9A to FIG. 9G show the movement of a single sheet.

When print data and a load paper command, a print start command, or other command necessitating a paper supply operation is received from the host computer 200, the ASF control unit 103 outputs a drive signal to the ASF motor 140 and drives the ASF motor 140 forward (S1). When the ASF motor 140 rotates in the forward direction, the paper supply roller unit 72 swings and presses the paper feed roller 78 against the stack of sheets S, and the paper feed roller 78 rotates and feeds the top sheet S from the bottom opening 60*b* into the paper transportation path 5 inside the main printer unit 1 as shown in FIG. 9A.

The paper feed motor 130 does not start immediately and simply waits until the sheet S is fed by the ASF 60 to a specific position inside the main printer unit 1 (S11, and S12 returns no).

Figure 9B:
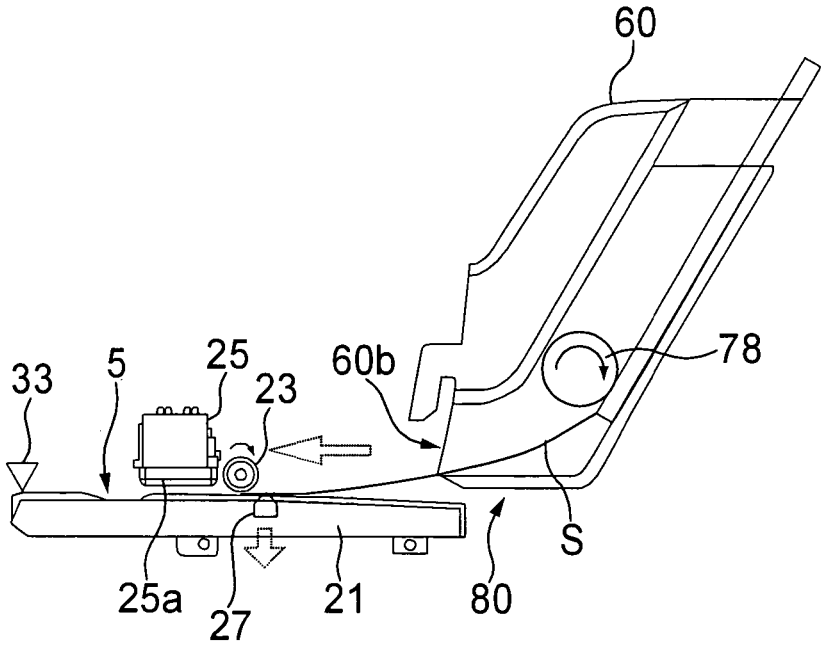

When the sheet S is fed by the paper feed roller 78 into the paper transportation path 5 and travels along the top of the platen 21, the sheet S contacts the BOF lever 27 and thus pushes the BOF lever 27 down (FIG. 9B). When the BOF lever 27 thus descends, the BOF sensor 27*a* outputs an ON signal (S2 returns yes). When the ASF control unit 103 receives this ON signal, the ASF control unit 103 starts measuring the time from when the ON signal was received and determines if a specific time has passed (S3). This specific time is set to the transportation time required for the single sheet S to be conveyed from where the leading edge is detected by the BOF sensor 27*a* to where the sheet S is nipped by the main paper transportation roller 23 and pressure roller 24 and can be conveyed by the drive power of the main paper transportation roller 23.

Figure 9C:
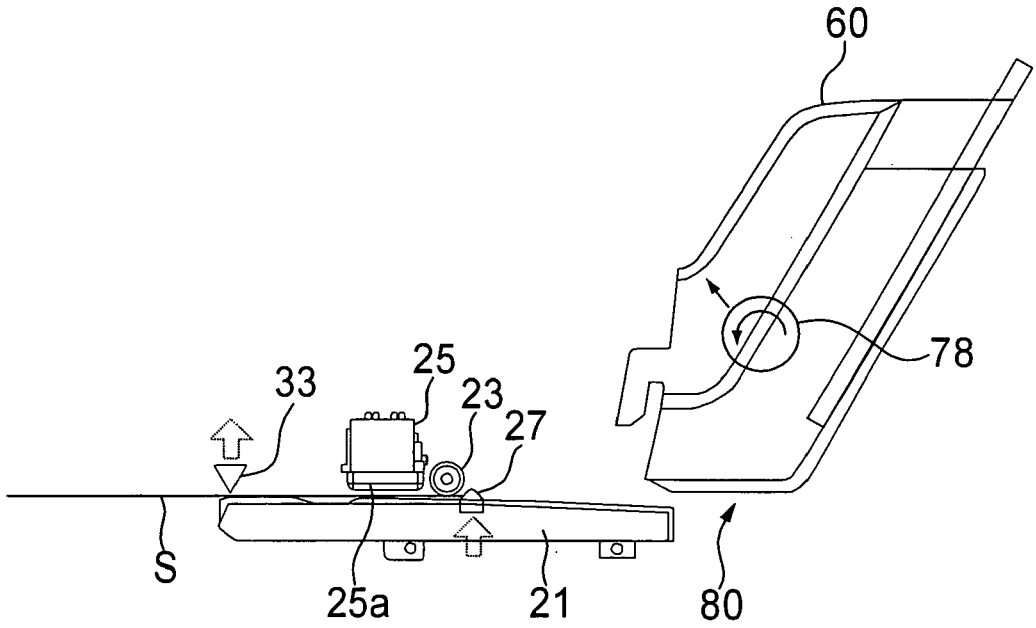

When this specific time has passed (S3 returns yes), the ASF control unit 103 outputs a drive signal to the ASF motor 140 to drive the ASF motor 140 in reverse (S4). When the ASF motor 140 turns in reverse, the paper supply roller unit 72 swings in the direction in which the paper feed roller 78 separates from the sheet S and the sheet S is thus freed from the paper feed roller 78 (FIG. 9C). The ASF control unit 103 stops driving the ASF motor 140 in reverse after the time required for the paper supply roller unit 72 to be positioned at a specific retracted position, and the paper supply roller unit 72 is thus held in this retracted position (S5).

The paper transportation control unit 101 then drives the paper feed motor 130 forward according to the ON signal received from the BOF sensor 27*a* (S13). When the paper feed motor 130 turns in the forward direction the main paper transportation roller 23 and paper transportation sub-roller 34 also turn forward and the sheet S is conveyed forward, that is, toward the front-side opening 5*a*.

When the sheet S contacts and pushes the TOF lever 33 up, the TOF sensor 33*a* outputs an ON signal. The sheet S is conveyed further forward until the trailing edge of the paper separates from (passes) the BOF lever 27. The BOF lever 27 thus moves up and the BOF sensor 27*a* outputs an OFF signal.

Figure 9D:
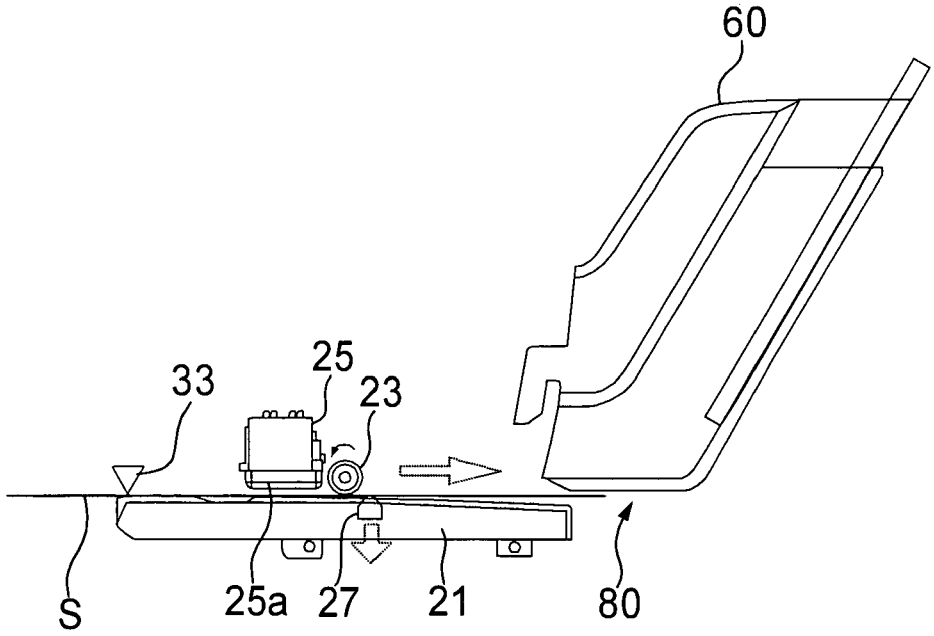

When the OFF signal is received from the BOF sensor 27*a* (S14 returns yes), the paper transportation control unit 101 reverses the paper feed motor 130 (S15). When the paper feed motor 130 turns in reverse, the main paper transportation roller 23 and paper transportation sub-roller 34 turn in reverse and the sheet S is conveyed in reverse toward the back-side opening 5*b* (FIG. 9D). When the sheet S is reversed, the sheet S again depresses the BOF lever 27 and the BOF sensor 27*a* thus again outputs the ON signal.

When the sheet S is thus reversed, the sheet S overhangs from the back-side opening 5*b* of the main printer unit 1 as shown in FIG. 9D, and travels straight into the reverse paper transportation path 80, that is, the space provided below the ASF 60. An inkjet printer according to this embodiment of the invention is thus arranged and paper transportation is controlled so that the sheet S does not enter the ASF 60 again after being supplied from the ASF 60 into the main printer unit 1.

Figure 9E:
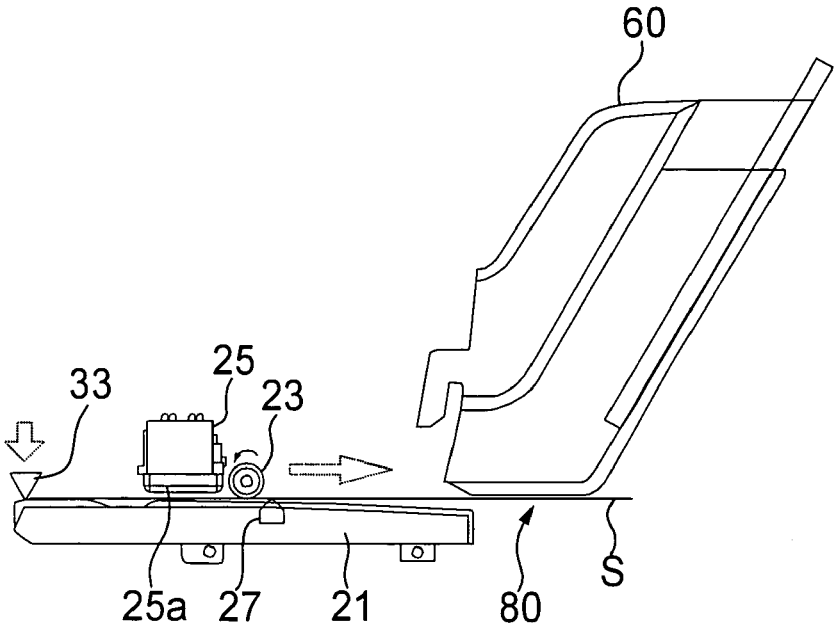

As the sheet S is reversed, the leading edge of the sheet S separates from the TOF lever 33. The depressed TOF lever 33 thus returns to the original (off) position and the TOF sensor 33*a* outputs the OFF signal (FIG. 9E).

When the paper transportation control unit 101 confirms that the TOF sensor 33*a* output the OFF signal (S16 returns yes), the rotational distance of the paper feed motor 130 (or drive pulse count) is counted to convey the sheet S a further specific distance (number of revolutions) in reverse (S17). This reverse transportation is to position (index) the sheet S to the print head 25*a*. The paper feed motor 130 is thus reversed the number of revolutions required to position the sheet S to a predefined position such as the printing start position of the sheet S.

Figure 9F:
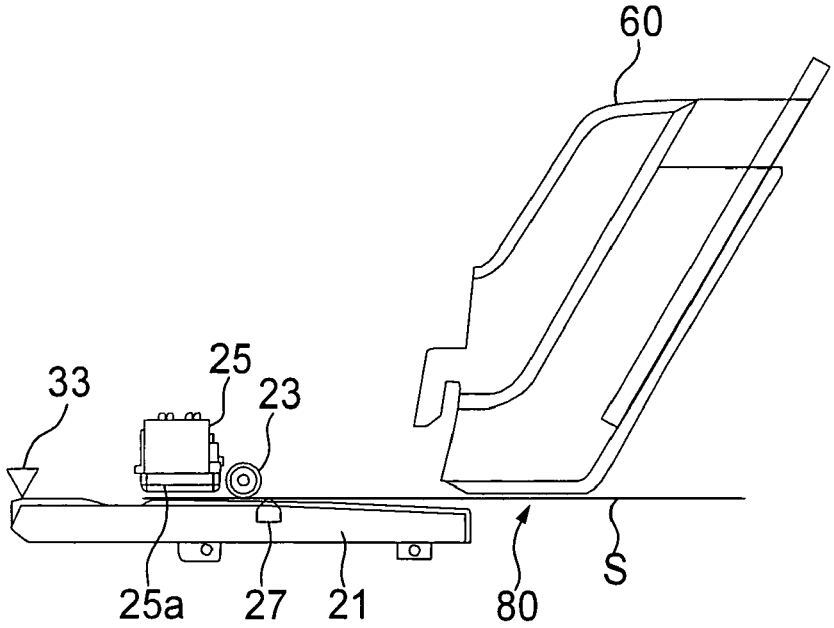
Figure 9G:
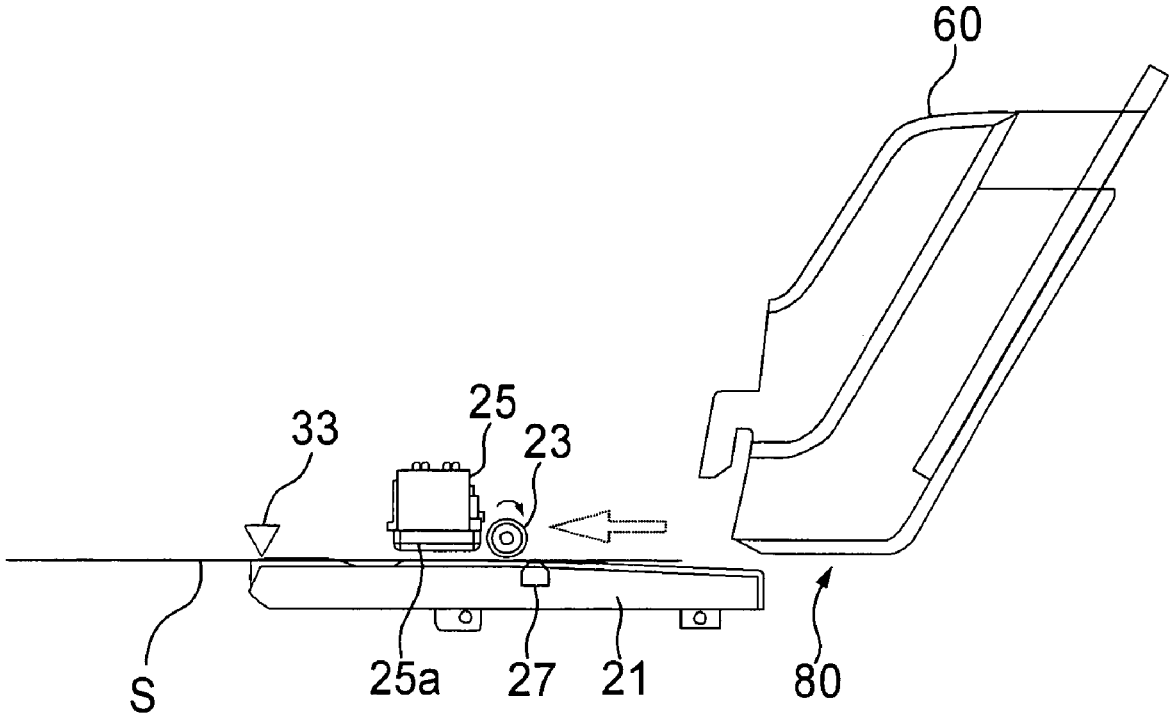

Once the sheet S is positioned to the print head 25*a* as shown in FIG. 9F, the carriage 25 and print head 25*a* are driven to start printing on the sheet S (S18). The sheet S is advanced forward at a specific pitch according to the print data by the paper feed motor 130 while the sheet S is printed (FIG. 9G). When printing by the print head 25*a* ends, the sheet S is discharged from the front-side opening 5*a* (S19) and the printing process ends.

Second Embodiment

Figure 10:
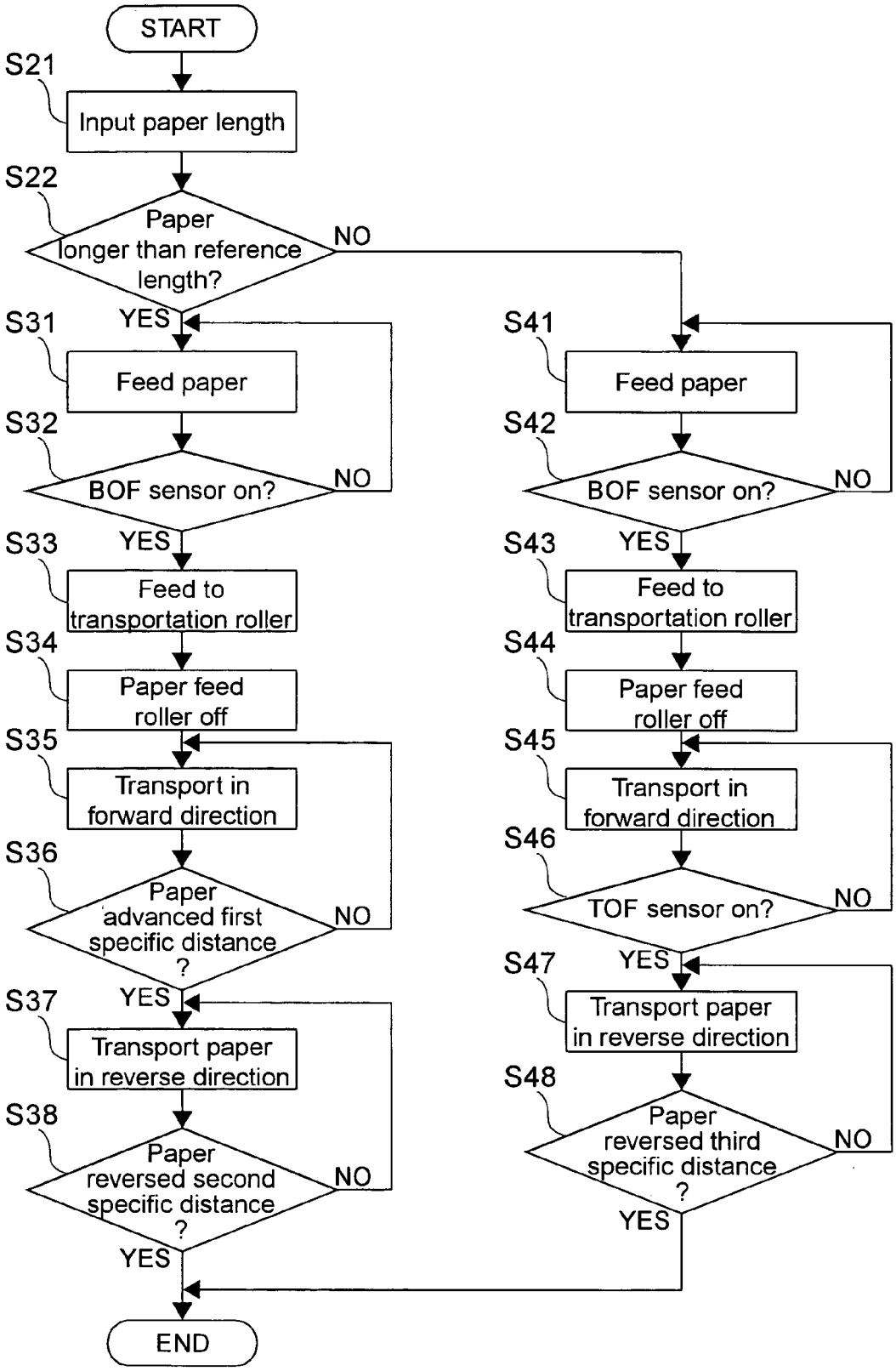
FIG. 10 is a flow chart describing the paper supply and indexing process in a second embodiment of the invention.

FIG. 10 is a flow chart of the process for supplying and positioning (indexing) a sheet S for the start of printing. FIG. 11A to FIG. 11D and FIG. 12A to FIG. 12D schematically show the movement (transportation) of the sheet S and sheet T during this process.

Figure 11A:
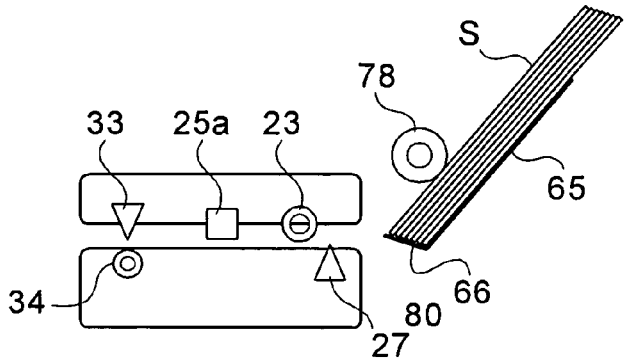
FIG. 11A to FIG. 11D show the movement of a single sheet in the paper supply and indexing process in the second embodiment of the invention.
Figure 11B:
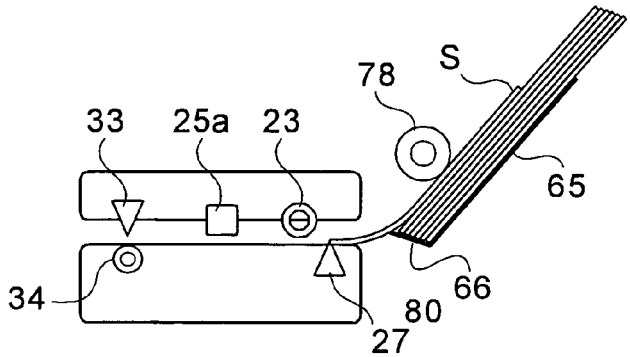
Figure 12A:
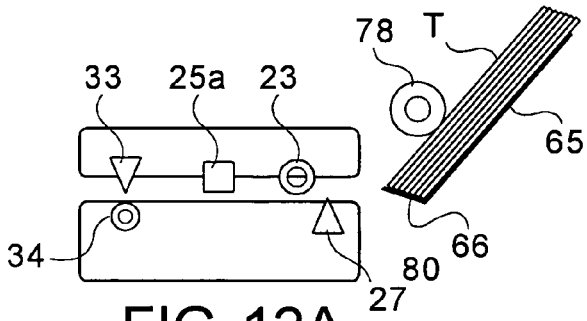
FIG. 12A to FIG. 12E show the movement of a single sheet in the paper supply and indexing process in the second embodiment of the invention.
Figure 12B:
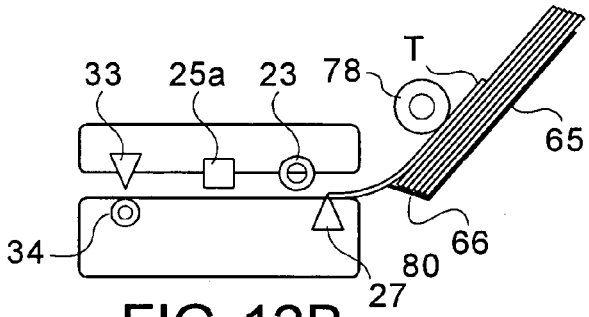

FIG. 11A and FIG. 12A respectively show sheets S and sheets T loaded in the ASF 60. Sheets T in this embodiment are short enough so that when a sheet T is fed into the main printer unit 1 and the leading edge of the sheet T is at the detection position of the TOF lever 33, the trailing edge has separated completely from the ASF 60.

When a print command is sent from the host computer 200 to the inkjet printer, the transportation length of the paper to be supplied is input to the control circuit board 35 before the paper feed operation begins (S21). The paper length can be acquired from the page size information contained in the print data sent from the host computer 200, for example.

Whether the length of the input paper is less than or equal to a reference length is then determined (S22). This reference length is the length of the transportation path from the bottom opening 60*b* of the ASF 60 to the TOF lever 33, and is the length from where the trailing edge just separates from the bottom panel 66 of the ASF 60 to where the leading edge of the paper reaches the TOF lever 33.

Supplying paper from the ASF 60 to the main printer unit 1 starts after the paper length is determined (S31, S41). The sheet S or sheet T is then conveyed by the paper feed roller 78 until the leading edge of the sheet reaches the main paper transportation roller 23 by continuing to drive the paper feed roller 78 a specific distance after the BOF sensor 27*a* goes ON (detects paper) (S32–S33, S42–S43, and FIG. 11B and FIG. 12B).

When the sheet S or sheet T is conveyed to the main paper transportation roller 23 inside the main printer unit 1, the ASF motor 140 is reversed to rotate the paper supply roller unit 72 toward the top cover 70, thus separating the paper feed roller 78 from the surface of the paper. Driving the ASF motor 140 then stops (S34, S44).

The sheet S or sheet T is then passed from the paper feed roller 78 to the main paper transportation roller 23 and conveyed forward by the main paper transportation roller 23 (S35, S45).

Figure 11C:
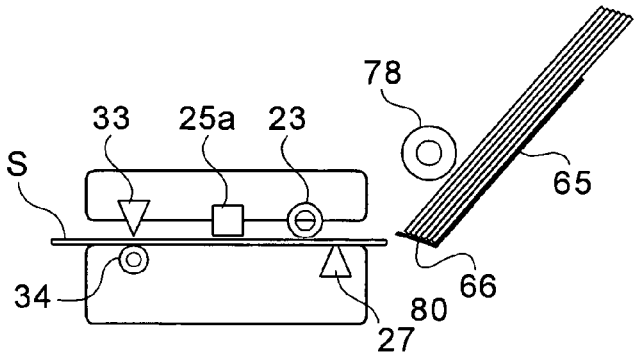
Figure 11D:
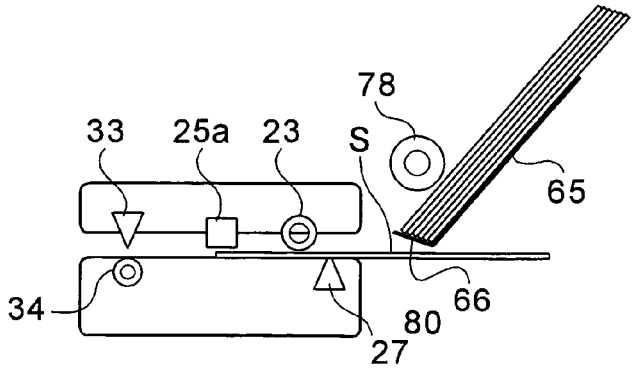

If the length of the paper is greater than the reference length, whether the sheet S has been conveyed a first specific distance since the BOF sensor 27*a* turned on is determined (S36). This first specific distance is the length of the sheet S minutes the transportation distance between the BOF lever 27 and the edge of the bottom panel 66 of the ASF 60. When the leading edge of the sheet S reaches the BOF lever 27 and the BOF sensor 27*a* turns on, the trailing end part of the sheet S remains inside the ASF 60. The length of the part of the sheet S remaining inside the ASF 60 is equal to this first specific distance, that is, the length of the sheet S minus the distance from the BOF lever 27 to the edge of the bottom panel 66 of the ASF 60. The trailing edge of the sheet S will therefore advance to the position where the trailing edge separates from the ASF 60 if the sheet S is conveyed this first specific distance after the BOF sensor 27*a* turns on (FIG. 11C).

The sheet S is then conveyed a second specific distance in reverse (S37, S38). This second specific distance is the first specific distance used in step S36 minus the distance from the BOF lever 27 to the leading edge of the sheet S when the sheet S is at the printing start position. This second specific distance is thus the transportation distance required to index the sheet S for printing by reversing the sheet S the distance that the leading edge of the sheet S travelled beyond the printing start position as a result of conveying the sheet S until the trailing edge separated from the ASF 60.

If the sheet S is conveyed the specific distance in reverse (S38 returns yes), the leading edge of the sheet S has moved to the printing start position (FIG. 11D) and the paper feed and indexing process ends.

Figure 12C:
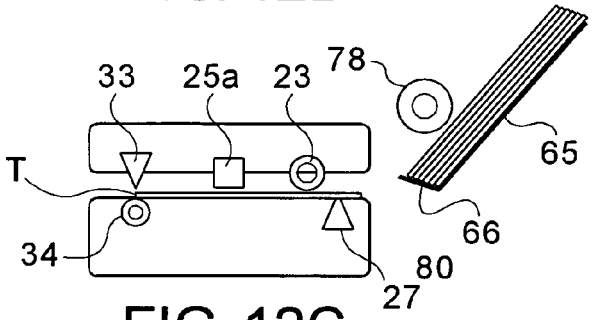

If the sheet T is a sheet that is shorter than the reference length, the sheet T is conveyed forward by the main paper transportation roller 23 until the TOF sensor 33*a* turns on, that is, until the leading edge of the sheet T reaches the TOF lever 33 (S45, S46, and FIG. 12C). As noted above, sheet T is paper of a length such that the trailing edge separates from the ASF 60 when the leading edge reaches the TOF lever 33. As a result, reversing the sheet T from this position advances the sheet T into the reverse paper transportation path 80.

Figure 12D:
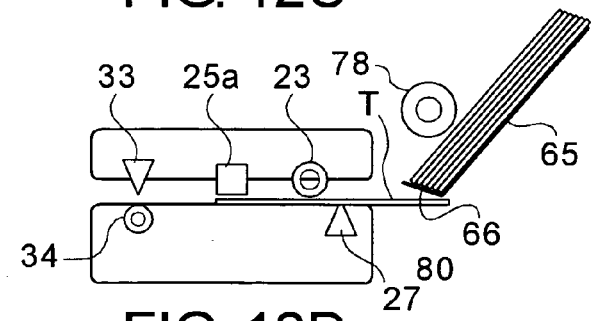

To then move the leading edge of the sheet T from this location at the TOF lever 33 to the printing start position, the sheet T is conveyed in reverse a third specific distance while measuring the distance travelled by the paper (rotational distance or drive pulse count of the paper feed motor 130) from where the TOF sensor 33*a* turns on (S47, S48). This third specific distance is the distance required to move the leading edge of the sheet T from the TOF lever 33 position to the printing start position (FIG. 12D). The paper feed and indexing operation then ends.

It will also be obvious that if the margin between the leading edge of the paper and the printing start position is greater than the transportation distance from the TOF lever to the print head, the paper could be conveyed in the forward direction instead of in the reverse direction in step S47.

Figure 12E:
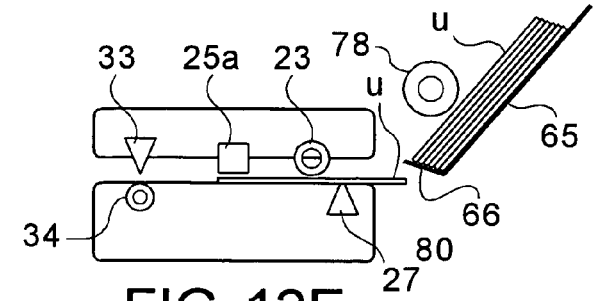

Furthermore, if the sheet U is even shorter so that the trailing edge of the sheet separates from the ASF 60 when the paper is set to the printing start position as shown in FIG. 12E, the sheet U could be conveyed a fourth specific distance forward without executing steps S45 to S48. This fourth specific distance is the distance from the main paper transportation roller 23 to the leading edge of the sheet U when the sheet U is at the printing start position.

This second embodiment of the invention can thus select the process for conveying the sheet until the trailing edge of the sheet separates from the ASF 60 according to the transportation length of the sheet and the printing start position (the margin from the leading edge of the page).

The paper transportation time can thus be shortened by thus minimizing the transportation distance, and the paper can thus be supplied and indexed more efficiently.

Third Embodiment

This third embodiment of the invention differs from the foregoing first embodiment in that the forward transportation distance (S12 to S14) is counted from when the BOF detector turns on until the BOF detector turns off. After conveying the sheet S forward until the BOF detector turns off, the sheet S is positioned by conveying the sheet S in reverse a fifth specific distance instead of executing steps S15 to S17 as described in the first embodiment.

This fifth specific distance is the transportation distance from when the BOF sensor 27*a* turns on to when the BOF sensor 27*a* turns off minus the distance from the BOF lever 27 to the leading edge of the sheet S when the sheet S is in the printing start position. More specifically, this is the transportation distance required to return the sheet S the distance that the leading edge of the sheet S is conveyed beyond the printing start position as a result of advancing the sheet S until the trailing edge thereof separates from the ASF 60, and thereby index the sheet S for printing.

This third embodiment of the invention can thus feed and index the paper using only one paper detector.

The present invention shall not be limited to the preferred embodiments described above and can be varied in many ways without departing from the scope of the invention as will be known from a few variations thereof described below.

(Variation 1)

The paper positioning process described in the first or third embodiments can be substituted for steps S31 to S38 in the second embodiment.

(Variation 2)

If the transportation length of the paper being used is constant in the second embodiment, the paper feed and indexing process can be executed according to the paper length without inputting the length of the paper.

(Variation 3)

The paper length is acquired from the print data sent from the host computer 200, for example, in the second embodiment. The paper length information could be acquired, for example, by providing separate paper cassettes for each paper length and detecting which paper cassette is in use. A paper detector could also be provided in the ASF 60 so that the paper length can be acquired from this paper detector. The paper size could also be input by selectively operating a switch.

(Variation 4)

The paper is indexed for printing by executing steps S41 to S48 when the length of the sheet T is short in the second embodiment, but the paper could be indexed using steps S31 to S38. Indexing (positioning) precision is improved by the former case because the paper is conveyed in one direction from where the leading edge is detected to the printing start position. In the latter case, however, the transportation distance required for paper feeding and indexing is shortened, the processing time can thus be shortened, and operation is thus more efficient. The best method can therefore be selected according to the required print quality.

(Variation 5)

The ASF 60 is disposed above the paper transportation path 5 in the foregoing embodiments. The problems solved by the present invention could also exist when the ASF 60 is disposed below the paper transportation path 5, however, and the present invention can be used to the same benefit and effect in such situations.

(Variation 6)

The sheet recording media described in the foregoing embodiments is assumed to be paper, but the present invention is not limited to use with paper and can be used with any type of sheet recording media.

(Variation 7)

Paper is directly detected in the foregoing embodiments as a result of the paper directly contacting a detection lever, but a contactless detection method using a reflection or transmission type optical sensor could be used. Using a contactless paper detector affords more accurate paper detection even if the position relative to the thickness of the paper is not consistent.

(Variation 8)

The present invention is described above using by way of example an inkjet printer. The present invention shall not be so limited, however, and could use a different type of print head instead of print head 25*a*. The present invention has the same effect regardless of the type of print head used because the present invention maintains a stable paper feed pitch for the sheet S.

A printer and printer control method according to the present invention thus start printing after the print medium is completely discharged from the paper storage and supply device. Problems arising from printing starting while the trailing end of the paper remains in the paper storage and supply device and the paper is greatly curled are thus prevented. The paper can thus be printed under consistent, stable conditions without additional tension being applied to the paper by curling. In other words, the paper can be consistently, stably printed without variation in the paper feed pitch.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A printer comprising:

a paper storage housing for storing paper;

a paper transportation path formed between a paper entrance and a paper exit for conveying the paper;

a paper feed roller for feeding paper from the paper storage housing onto said paper transportation path;

a transportation roller disposed along the paper transportation path for conveying said paper along said paper transportation path in a first direction and in a second direction that is opposite the first direction;

a print head disposed along the paper transportation path;

a first paper detector disposed along the paper transportation path for detecting if paper is present;

a second paper detector disposed along the paper transportation path on the downstream side in the first direction of the print head and the first paper detector for detecting if paper is present; and a control unit for controlling the direction of travel of the paper such that the paper travels in the first direction until the paper is discharged from the paper storage housing, and then travels in the second direction to the print head;

wherein the control unit reverses the direction of travel of the paper from the first direction to the second direction based on change in the first paper detector from a paper-present to a paper-not-present state during transportation of the paper in the first direction, and positions the paper to the print head based on change in the second paper detector from the paper-present to the paper-not-present state during transportation of the paper in the second direction.

2. The printer of claim 1, wherein the first paper detector, the transportation roller, the print head, and the second paper detector are arranged in sequence in the first direction along the paper transportation path from the paper storage housing.

3. A printer comprising:

a paper storage housing for storing paper;

a paper transportation path formed between a paper entrance and a paper exit for conveying the paper;

a paper feed roller for feeding paper from the paper storage housing onto the paper transportation path;

a transportation roller disposed along the paper transportation path for conveying the paper along the paper transportation path in a first direction and in a second direction that is opposite the first direction;

a paper detector disposed along the paper transportation path for detecting if paper is present;

a counter responsive to a detection signal from the paper detector for measuring the length of the paper as it conveyed in the first direction along the paper transportation path;

a print head disposed along the paper transportation path; and a control unit for controlling the direction of travel of the paper such that the paper travels in the first direction until the paper is discharged from the paper storage housing, and then travels in the second direction to the print head;

wherein the control unit reverses the direction of travel of the paper from the first direction to the second direction based on change in the paper detector from a paper-present to a paper-not-present state during transportation of the paper in the first direction, and positions the paper to the print head based on the measured paper length of the counter.

4. A printer comprising:

a paper storage housing for storing paper;

a paper transportation path formed between a paper entrance and a paper exit for conveying the paper;

a paper feed roller for feeding paper from the paper storage housing onto the paper transportation path;

a transportation roller disposed along the paper transportation path for conveying the paper along the paper transportation path in a first direction and in a second direction that is opposite the first direction;

a paper detector disposed along the paper transportation path for detecting a leading edge of the paper supplied from the paper storage housing;

a length information acquisition unit for acquiring the length of the paper supplied from the paper storage housing;

a print head disposed along the paper transportation path; and a control unit for controlling the direction of travel of the paper such that the paper travels in the first direction until the paper is discharged from the paper storage housing, and then travels in the second direction to the print head;

wherein the control unit, based on a detection signal from the paper detector and the length of the paper from the length acquisition unit, conveys the paper in the first direction until a trailing edge of the paper at least separates from the paper storage housing, and then conveys the paper in the second direction so as to position the paper to the print head.

5. A control method for controlling the printing operation in a printer having a paper storage housing for holding paper, a paper transportation path formed between a paper entrance and a paper exit along which the paper is conveyed, and a print head disposed along the paper transportation path, the control method comprising the steps of:

(a) conveying paper from the paper storage housing onto the paper transportation path;

(b) conveying the paper supplied from the paper storage housing along the paper transportation path in a first direction until the paper is discharged from the paper storage housing; and (c) conveying the paper along the paper transportation path in a second direction opposite the first direction after the paper is discharged from the paper storage housing so as to position the paper to the print head;

wherein step (b) comprises:

(b1) detecting a trailing edge of the paper at a first position on the paper transportation path, and (b2) conveying the paper in the first direction until the trailing edge of the paper is detected in step (b1) and step (c) comprises:

(c1) detecting a leading edge of the paper at a second position on the first direction side of the print head and first position; and (c2) positioning the paper to the print head based on the transportation distance of the paper in the second direction after the leading edge of the paper is detected in step (c1).

6. A control method for controlling the printing operation in a printer having a paper storage housing for holding paper, a paper transportation path formed between a paper entrance and a paper exit along which the paper is conveyed, and a print head disposed along the paper transportation path, the control method comprising the steps of:

(a) conveying paper from the paper storage housing onto the paper transportation path;

(b) conveying the paper supplied from the paper storage housing along the paper transportation path in a first direction until the paper is discharged from the paper storage housing; and (c) conveying the paper along the paper transportation path in a second direction opposite the first direction after the paper is discharged from the paper storage housing so as to position the paper to the print head;

wherein step (b) comprises:

(b1) detecting a leading edge of the paper at a specified position on the paper transportation path;

(b2) detecting a trailing edge of the paper at the specified position on the paper transportation path;

(b3) conveying the paper in the first direction until the trailing edge of the paper is detected in step (b2); and (b4) counting the length of the paper in the transportation direction based on the detection results in steps (b1) and (b2); and step (c) comprises:

(c1) positioning the paper to the print head based on the length of the paper.

7. A control method for controlling the printing operation in a printer having a paper storage housing for holding paper, a paper transportation path formed between a paper entrance and a paper exit along which the paper is conveyed, and a print head disposed along the paper transportation path, the control method comprising the steps of:

(a) acquiring paper length information in the transportation direction;

(b) detecting a leading edge of the paper at a specified position on the paper transportation path;

(c) conveying the paper from the paper storage housing onto the paper transportation path;

(d) conveying the paper supplied from the paper storage housing along the paper transportation path in a first direction until a trailing edge of the paper at least separates from the paper storage housing based on the detection result in step (b) and the paper length information acquired in step (a) and (e) conveying the paper along the paper transportation path in a second direction opposite the first direction after the trailing edge of the paper separates from the paper storage housing so as to position the paper to the print head based on the transportation distance of the paper in step (d) after the leading edge of the paper is detected in step (b) and the paper length information acquired in step (a).

* * * * *